US010932064B2

(12) United States Patent
Cai et al.

(10) Patent No.: US 10,932,064 B2
(45) Date of Patent: Feb. 23, 2021

(54) CONDENSER MICROPHONE AND ELECTRONIC DEVICE

(71) Applicant: GOERTEK INC., Shandong (CN)

(72) Inventors: Mengjin Cai, WeiFang (CN); Junkai Zhan, WeinFang (CN)

(73) Assignee: WEIFANG GOERTEK MICROELECTRONICS CO., LTD

( * ) Notice: Subject to any disclaimer, the term of this patent is extended or adjusted under 35 U.S.C. 154(b) by 0 days.

(21) Appl. No.: 16/475,328

(22) PCT Filed: Oct. 25, 2017

(86) PCT No.: PCT/CN2017/107666

§ 371 (c)(1),
(2) Date: Jul. 1, 2019

(87) PCT Pub. No.: WO2019/061618

PCT Pub. Date: Apr. 4, 2019

(65) Prior Publication Data

US 2019/0342672 A1 Nov. 7, 2019

(30) Foreign Application Priority Data

Sep. 28, 2017 (CN) ..... 201710899470.X

(51) Int. Cl.
*H04R 19/04* (2006.01)
*H04R 7/04* (2006.01)
*H04R 7/16* (2006.01)

(52) U.S. Cl.
CPC ..... *H04R 19/04* (2013.01); *H04R 7/04* (2013.01); *H04R 7/16* (2013.01); *H04R 2201/003* (2013.01)

(58) Field of Classification Search
CPC ..... H04R 19/005; H04R 19/04; H04R 2201/003; H04R 7/04; H04R 7/14; H04R 7/16
See application file for complete search history.

(56) References Cited

U.S. PATENT DOCUMENTS 5,870,482 A * 2/1999 Loeppert ..... B81B 3/0072 381/174
2012/0090398 A1* 4/2012 Lee ..... H04R 19/005 73/715

(Continued)

FOREIGN PATENT DOCUMENTS

CN 201699978 U 1/2011
CN 102244832 A 11/2011

(Continued)

OTHER PUBLICATIONS

Office Action for Chinese Patent Application 201710899470X, dated May 7, 2019.

(Continued)

*Primary Examiner* — Tuan D Nguyen
(74) *Attorney, Agent, or Firm* — Holzer Patel Drennan

(57) ABSTRACT

The present invention provides a condenser microphone, comprising a substrate, and a back plate and a vibrating diaphragm which are arranged on the substrate; the back plate is arranged on the upper side and/or the lower side of the vibrating diaphragm; and the vibrating diaphragm is provided with a protruding layer or a corrugated membrane structure layer. With the above invention, the area of the vibrating diaphragm and the capacitance at the lateral side of the condenser microphone can be increased, so as to achieve the effect of improving the sensitivity of the condenser microphone.

11 Claims, 3 Drawing Sheets

(56) References Cited

U.S. PATENT DOCUMENTS

Figure 1:
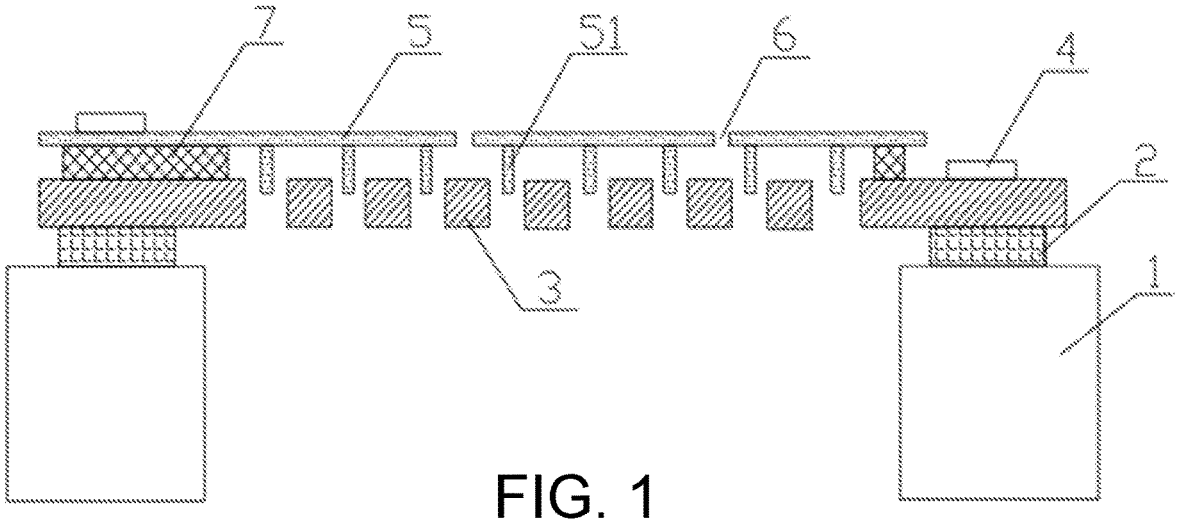

| | | | | |
|---|---|---|---|---|
| 2017/0026754 | A1* | 1/2017 | Buck | H04R 7/18 |
| 2017/0359648 | A1* | 12/2017 | Park | B81C 1/00015 |
| 2018/0115836 | A1* | 4/2018 | Hsieh | B81B 3/001 |

FOREIGN PATENT DOCUMENTS

| | | | |
|---|---|---|---|
| CN | 204014056 | U | 12/2014 |
| CN | 205510403 | U | 8/2016 |
| WO | 2007024943 | A | 3/2007 |

OTHER PUBLICATIONS

Search Report for International Patent Application PCT/CN2017/107666, dated May 6, 2018, Machine Translation.

* cited by examiner

CONDENSER MICROPHONE AND ELECTRONIC DEVICE

TECHNICAL FIELD

The present invention relates to the acoustic technical field, and more particularly, relates to a condenser microphone and an electronic device.

BACKGROUND

With the progress of society and the development of technology, in recent years, the volume of electronic products such as mobile phones, notebook PC and the like has been continuously reduced, and the performance requirements with respect to these portable electronic products are getting higher, thereby requiring the volume of the accompanying electronic components to decrease constantly, and performance and consistency of the accompanying electronic components to improve constantly. The condenser microphones begin to be applied into electronic products such as mobile phones, notebook PC and the like in a great quantity, and the package volume thereof is smaller than that of the traditional electret microphones, therefore the condenser microphones are preferred by most of the microphone manufacturers.

Among them, the condenser microphone mainly utilizes the principle of charging and discharging of capacitance between the conductors, and senses the sound pressure through the vibrating diaphragm to directly convert the electrostatic voltage change between the conductors into the electrical energy signal. The sensitivity level of the condenser microphone mainly associates with the capacitance value and the corresponding changes of the capacitance generated by the capacitance value due to the change of the sensed sound pressure. At present, the vibrating diaphragm area of the present condenser microphone is limited, resulting in insufficient capacitance at the lateral side, thereby affecting the improvement of the sensitivity of the products.

SUMMARY

In view of the above problems, an object of the present invention is to provide a condenser microphone and an electronic device to resolve the problem that the improvement of the product sensitivity is limited and the product performance is affected due to the existing condenser microphone construction.

The condenser microphone provided by the present invention comprises a substrate, and a back plate and a vibrating diaphragm which are arranged on the substrate; the back plate is arranged at an upper side and/or a lower side of the vibrating diaphragm; and the vibrating diaphragm is provided with a protruding layer or a corrugated membrane structure layer.

In addition, it is preferred that when the vibrating diaphragm is provided with the protruding layer, the back plate is arranged on the substrate through a supporting layer, and the vibrating diaphragm is arranged at a side of the back plate away from the substrate through an insulating layer; wherein the protruding layer extends perpendicularly towards the back plate.

In addition, it is preferred that when the vibrating diaphragm is provided with the protruding layer, the vibrating diaphragm is arranged on the substrate through a supporting layer, and the back plate is arranged at a side of the vibrating diaphragm away from the substrate through an insulating layer; and the protruding layer extends perpendicularly towards the back plate.

In addition, it is preferable that when the vibrating diaphragm is provided with the corrugated membrane structure layer, the back plate is arranged on the substrate through a supporting layer, and the vibrating diaphragm is arranged at a side of the back plate away from the substrate through an insulating layer; and the corrugated membrane structure layer has a concave-convex construction adapted to a construction of the back plate.

In addition, it is preferable that when the vibrating diaphragm is provided with the corrugated membrane structure layer, the vibrating diaphragm is arranged on the substrate through a supporting layer, and the back plate is arranged at a side of the vibrating diaphragm away from the substrate through an insulating layer, and the corrugated membrane structure layer has a concave-convex construction adapted to a construction of the back plate.

In addition, it is preferable that when the vibrating diaphragm is provided with the protruding layer, back plates are arranged at two sides of the vibrating diaphragm; and the two sides of the vibrating diaphragm are provided with protruding layers extending perpendicularly towards corresponding back plates, respectively.

In addition, it is preferable that when the vibrating diaphragm is provided with the corrugated membrane structure layer, back plates are arranged at two sides of the vibrating diaphragm; and the corrugated membrane structure layer has a concave-convex construction adapted to constructions of the back plates at the two sides.

In addition, it is preferable that the protruding layer or the corrugated membrane structure layer is integral with the vibrating diaphragm.

In addition, it is preferable that the condenser microphone further comprises an electrode; and the electrode is used for connecting an internal circuit and an external circuit of the condenser microphone.

According to another aspect of the present invention, there is provided an electronic device comprising the condenser microphone described above.

With the above-described condenser microphone and electronic device, the back plate is arranged on the upper side and/or the lower side of the diaphragm, and the vibrating diaphragm is provided with a protruding layer or a corrugated membrane structure layer, and the protruding layer or the corrugated membrane structure layer can increase the capacitance at the lateral side of the product and improves the product sensitivity.

In order to achieve the above and related purposes, one or more aspects of the present invention comprise the features that will be described in detail below. The following description and the detail description of the accompanying drawings describe certain illustrative aspects of the present invention. However, these aspects are merely some of the various ways in which the principles of the present invention can be employed. In addition, the present invention is intended to comprise all such aspects and their equivalents.

DETAILED DESCRIPTION

In the following description, for the purposes of explanation, a plurality of particular details are explained in order to provide a thorough understanding with respect to one or more embodiments. However, it is apparent that these embodiments may be executed without these particular details. In other examples, a well-known structure and device are illustrated in the form of the block diagram in order to facilitate describing one or more embodiments.

In the description of the present invention, it should be understood that, the orientation or the positional relationship indicated by the terms "up", "down", "horizontal", "vertical" and the like are based on the orientation or the positional relationship illustrated in the drawings, merely for the convenience of describing the present invention and for simplifying the description, rather than indicating or implying that the described device or elements must have a specific orientation and must be configured and operated in a specific orientation, therefore it cannot be understood to be the restriction of the present invention.

In order to improve the sensitivity of the existing condenser microphone, in the condenser microphone of the present invention, the back plate is arranged at the upper side and/or the lower side of the vibrating diaphragm, and a protruding layer or a corrugated membrane structure layer is arranged on the vibrating diaphragm. The capacitance at the lateral side of the product can be increased through the protruding layer or the corrugated membrane structure layer, thereby improving the sensitivity and the acoustic performance of the product.

In order to describe the construction of the condenser microphone of the embodiments of the present invention in detail, the specific embodiments of the present invention will be described in detail in combination with the accompanying drawings below.

FIG. 1 shows the construction of the condenser microphone according to a first embodiment of the present invention.

As shown in FIG. 1, the condenser microphone according to a first embodiment of the present invention comprises a substrate 1, a back plate 3 arranged on the substrate 1 through a supporting layer 2, and a vibrating diaphragm 5 (downward) arranged on the side of the back plate 3 away from the substrate 1 through the insulating layer 7, wherein the vibrating diaphragm 5 is provided with a plurality of protruding layers 51 extending perpendicularly towards the back plate 3, and the protruding layers 51 are evenly distributed in a vertical shape and extend into the apertures of the back plate 3. The protruding layers 51 increase the overall area of the vibrating diaphragm 5 so as to achieve the purpose of increasing the capacitance at the lateral side of the condenser microphone (the capacitance between the vibrating diaphragm 5 and the back plate 3) and improving the product sensitivity.

In addition, the vibrating diaphragm 5 is provided with at least one sound hole 6 which is in communication with the outside, and the sound hole 6 is arranged at a position of the vibrating diaphragm 51 where the protruding layers 51 are not provided.

Figure 2:
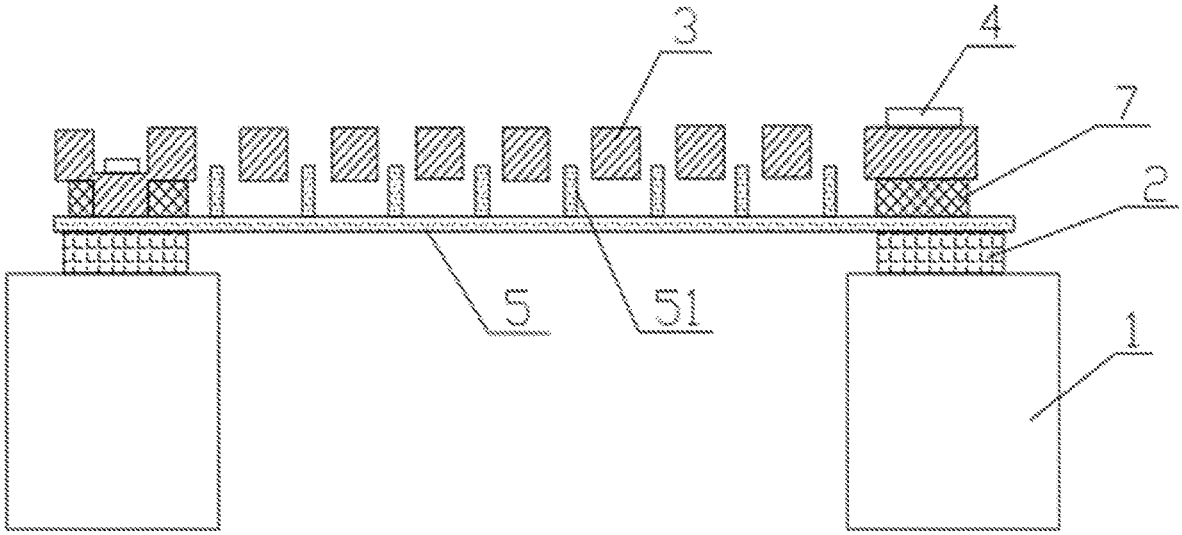

FIG. 2 shows the construction of the condenser microphone according to a second embodiment of the present invention.

As shown in FIG. 2, the condenser microphone according to a second embodiment of the present invention comprises a substrate 1, a vibrating diaphragm 5 arranged on the substrate 1 through a supporting layer 2, and a back plate 3 arranged on the side of the vibrating diaphragm 5 away from the substrate 1 through the insulating layer 7, wherein the vibrating diaphragm 5 is provided with a plurality of protruding layers 51 (upward) extending perpendicularly towards the back plate 3, and the protruding layers 51 are evenly distributed in a vertical shape and extend into the apertures of the back plate 3. The protruding layers 51 increase the overall area of the vibrating diaphragm 5 so as to eventually achieve the purpose of increasing the capacitance at the lateral side and improving the product sensitivity.

Figure 3:
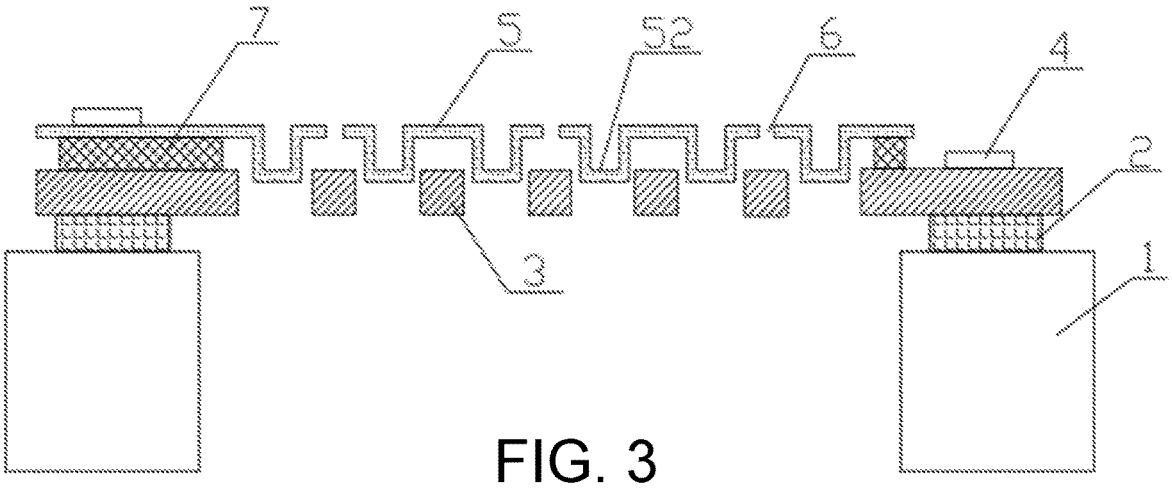

FIG. 3 shows the construction of the condenser microphone according to a third embodiment of the present invention.

As shown in FIG. 3, the condenser microphone according to a third embodiment of the present invention comprises a substrate 1, a back plate 3 arranged on the substrate 1 through a supporting plate, and a vibrating diaphragm 5 arranged on the side of the back plate 3 away from the substrate 1 through the insulating layer 7, wherein the vibrating diaphragm 5 is provided with a corrugated membrane structure layer 52 has a construction adapted to the construction of the back plate 3 and has a concave-convex construction, and the corrugated membrane structure layer 52 mainly refers to that the overall construction of the vibrating diaphragm 5 adopts a concave-convex construction, in other words, in order to increase the area of the vibrating diaphragm 5, the vibrating diaphragm 5 is configured to be a concave-convex corrugated membrane structure corresponding to the aperture structure of the back plate 3.

Wherein, the vibrating diaphragm 5 is further provided with at least one sound hole 6 which is in communication with the outside, and the sound hole 6 is arranged at the protruding position at the side of the vibrating diaphragm 5 away from the back plate 3.

Figure 4:
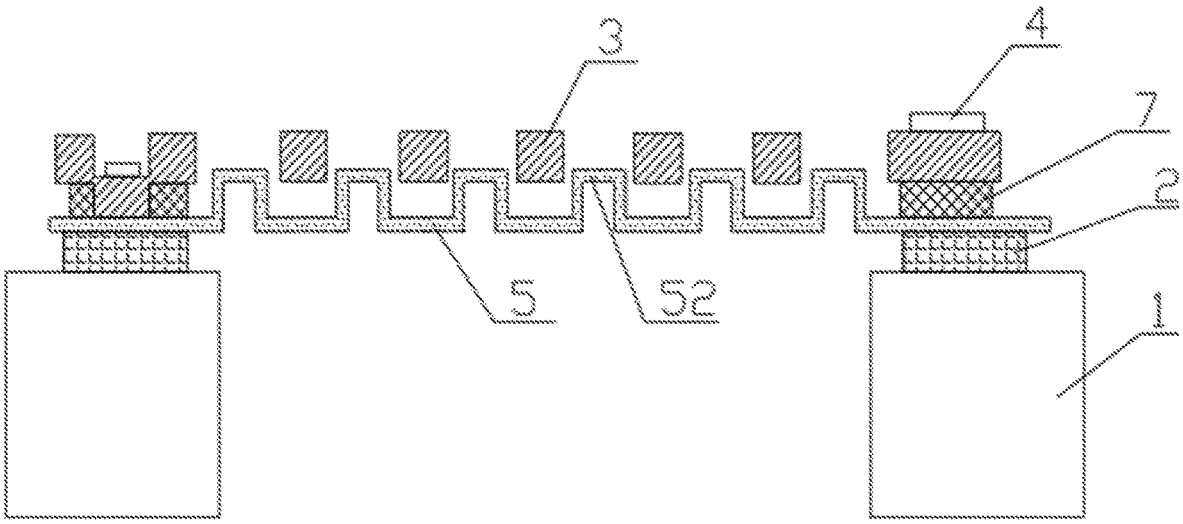

FIG. 4 shows the construction of the condenser microphone according to a fourth embodiment of the present invention.

As shown in FIG. 4, the condenser microphone according to a fourth embodiment of the present invention comprises a substrate 1, a vibrating diaphragm 5 arranged on the substrate 1 through a supporting plate, and a back plate 3 arranged on the side of the vibrating diaphragm 5 away from the substrate 1 through the insulating layer 7, wherein the vibrating diaphragm 5 is provided with a corrugated membrane structure layer 52 has a construction adapted to the construction of the back plate 3 and has a concave-convex construction, and the corrugated membrane structure layer 52 mainly refers to that the overall construction of the vibrating diaphragm 5 adopts a concave-convex construction. The vibrating diaphragm construction in this embodiment is similar to the vibrating diaphragm construction in the third embodiment, and there are only differences in the configuration position of the corrugated membrane structure layer (the relative position with the back plate) and the configuration of the sound hole.

Figure 5:
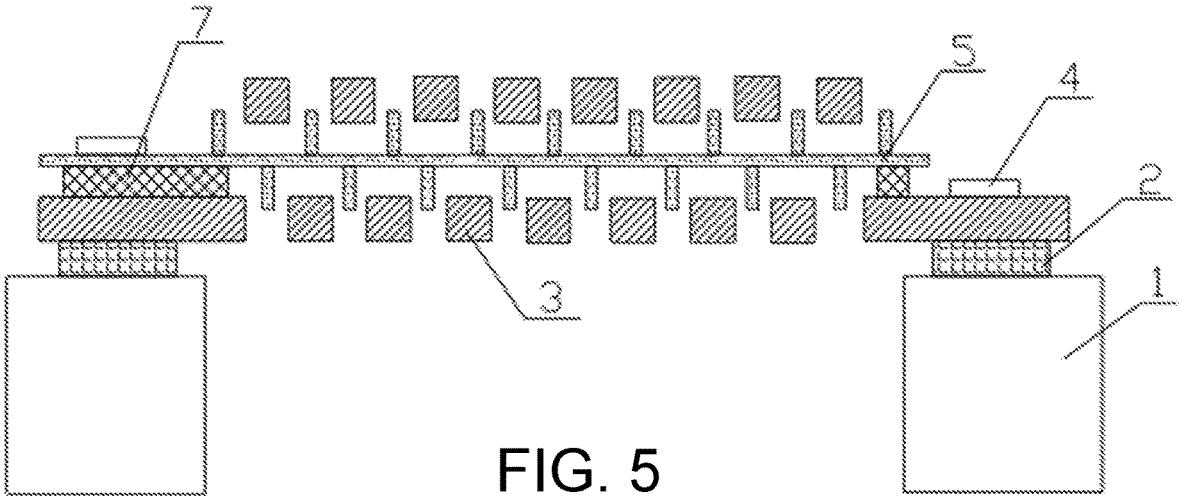

FIG. 5 shows the construction of the condenser microphone according to a fifth embodiment of the present invention.

As shown in FIG. 5, the condenser microphone according to a fifth embodiment of the present invention comprises a vibrating diaphragm 5 and two back plates 3 (comprising an upper back plate and a lower back plate) arranged on two sides of the vibrating diaphragm 5, wherein the lower back plate is arranged on the substrate 1 through the supporting layer 2, and the vibrating diaphragm 5 is arranged on the side of the lower back plate away from the substrate 1, and the side of the vibrating diaphragm 5 away from the substrate 1 is further provided with an upper back plate, and the vibrating diaphragm 5 is positioned between the upper back plate and the lower back plate.

In particular, the upper and lower sides of the vibrating diaphragm 5 are provided with a plurality of protruding layers 51 extending perpendicularly towards the corresponding back plates 3 respectively, and the protruding layers 51 are evenly distributed in a vertical shape and extend into the apertures of the corresponding back plates 3. In addition, the protruding layers positioned at the upper side of the vibrating diaphragm 5 and the protruding layers positioned at the lower side of the vibrating diaphragm 5 are also evenly distributed, i.e., all of the intervals between the adjacent protruding layers 51 are same in the horizontal direction.

Figure 6:
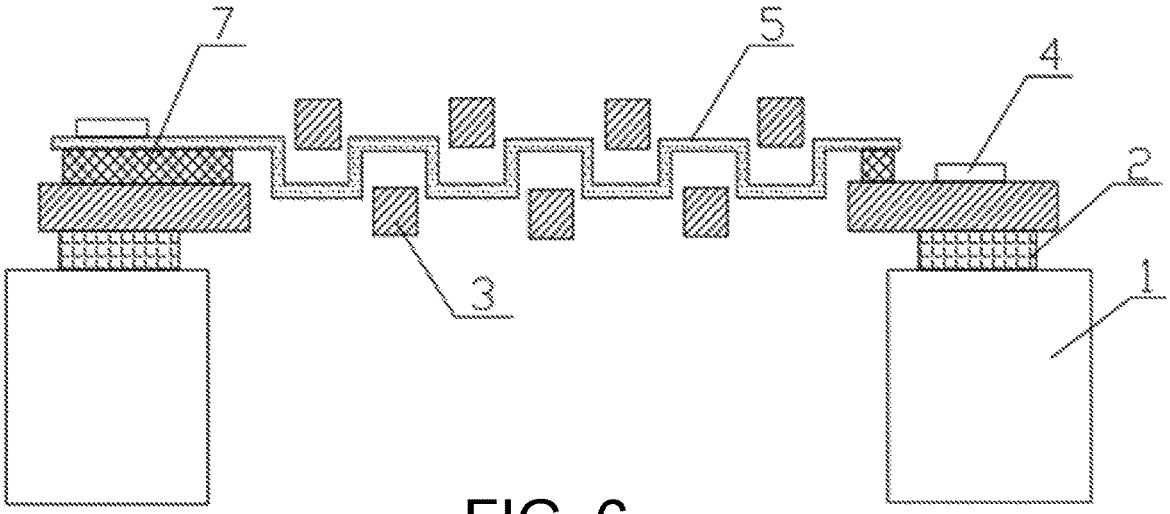

FIG. 6 shows the construction of the condenser microphone according to a sixth embodiment of the present invention.

As shown in FIG. 6, the condenser microphone according to a sixth embodiment of the present invention comprises a vibrating diaphragm 5 and two back plates 3 (comprising an upper back plate and a lower back plate) arranged on two sides of the vibrating diaphragm 5, wherein the lower back plate is arranged on the substrate 1 through the supporting layer 2, and the vibrating diaphragm 5 is arranged on the side of the lower back plate away from the substrate 1, and the side of the vibrating diaphragm 5 away from the substrate 1 is further provided with an upper back plate, and the vibrating diaphragm 5 is positioned between the upper back plate and the lower back plate.

In particular, the apertures of the upper back plate and the apertures of the lower back plate alternate with each other, and the vibrating diaphragm 5 is provided with a corrugated membrane structure layer 52 has a construction adapted to the constructions of the back plates 3 at the two sides and has a concave-convex construction, and the corrugated membrane structure layer 52 mainly refers to that the overall construction of the vibrating diaphragm 5 adopts a concave-convex construction so as to form a convex vibrating diaphragm construction in the apertures of the back plates 3 to achieve the purpose of increasing the capacitance at the lateral side and improving the product sensitivity.

It should be noted that each of the protruding layer 51 and the corrugated membrane structure layer 52 is a structural form of the vibrating diaphragm 5 in the embodiment of the present invention. The protruding layer 51 or the corrugated membrane structure layer 52 is configured into an integrated structure with the vibrating diaphragm 5, or it can be interpreted that the vibrating diaphragm 5 is distributed in a non-horizontal state and adopts a regular concave-convex construction, or a protruding structure extending perpendicularly towards one side and/or two sides of the vibrating diaphragm 5 is provided on the basis of the existing horizontal vibrating diaphragm 5, and the protruding layers 51 and the corrugated membrane structure layer 52 increase the overall area of the vibrating diaphragm 5 so as to increase the capacitance at the lateral side of the condenser microphone and improve the product sensitivity.

In a particular embodiment of the present invention, the condenser microphone further comprises electrodes 4, and two electrodes 4 are arranged on two sides of the vibrating diaphragm 5 respectively for connecting the internal circuit of the condenser microphone with the external circuit.

In correspondence to the above-described condenser microphone, the present invention further provides an electronic device comprising a housing and the above-described condenser microphone accommodated in the housing.

The condenser microphone and the electronic device according to the present invention are described above by way of example with reference to the accompanying drawings. However, those skilled in the art should understand that various improvements can be applied to the condenser microphone and the electronic device provided in the present invention as described above without departing from the contents of the present invention. Therefore, the protection scope of the present invention should be determined by the contents of the appended claims.

What is claimed is:

1. A condenser microphone, comprising a substrate, and a back plate and a vibrating diaphragm arranged on the substrate, wherein the back plate is arranged on at least one of an upper side and a lower side of the vibrating diaphragm;

the vibrating diaphragm is provided with one of a protruding layer and a corrugated membrane structure layer; where when the vibrating diaphragm is provided with the protruding layer, the vibrating diaphragm has at least one sound hole through the vibrating diaphragm in communication with an outside and in a location where the protruding layer is not present; and when the vibrating diaphragm is provided with the corrugated membrane structure layer, the corrugated membrane structure has a concave-convex construction adapted to a construction of the back plate.

2. The condenser microphone according to claim 1, wherein when the vibrating diaphragm is provided with the protruding layer, the back plate is arranged on the substrate through a supporting layer, and the vibrating diaphragm is arranged at a side of the back plate away from the substrate through an insulating layer; and the protruding layer extends perpendicularly towards the back plate.

3. The condenser microphone according to claim 1, wherein when the vibrating diaphragm is provided with the protruding layer, the vibrating diaphragm is arranged on the substrate through a supporting layer, and the back plate is arranged at a side of the vibrating diaphragm away from the substrate through an insulating layer; and the protruding layer extends perpendicularly towards the back plate.

4. The condenser microphone according to claim 1, wherein when the vibrating diaphragm is provided with the corrugated membrane structure layer, the back plate is arranged on the substrate through a supporting layer, and the vibrating diaphragm is arranged at a side of the back plate away from the substrate through an insulating layer.

5. The condenser microphone according to claim 1, wherein when the vibrating diaphragm is provided with the corrugated membrane structure layer, the vibrating diaphragm is arranged on the substrate through a supporting layer, and the back plate is arranged at a side of the vibrating diaphragm away from the substrate through an insulating layer.

6. The condenser microphone according to claim 1, wherein when the vibrating diaphragm is provided with the protruding layer, back plates are arranged at two sides of the vibrating diaphragm; and two sides of the vibrating diaphragm are provided with protruding layers extending perpendicularly toward corresponding back plates, respectively.

7. The condenser microphone according to claim 1, wherein when the vibrating diaphragm is provided with the corrugated membrane structure layer, back plates are arranged at two sides of the vibrating diaphragm.

8. The condenser microphone according to claim 1, wherein the protruding layer or the corrugated membrane structure layer is integral with the vibrating diaphragm.

9. The condenser microphone according to claim 1, further comprising an electrode, wherein the electrode connects an internal circuit and an external circuit of the condenser microphone.

10. An electronic device, comprising the condenser microphone according to claim 1.

11. The condenser microphone according to claim 1, wherein the one of the protruding layer and the corrugated membrane structure layer increases the capacitance of the vibrating diaphragm at a lateral side and improves sensitivity of the condenser microphone.

* * * * *